US009497529B2

(12) United States Patent
Jeziorek et al.

(10) Patent No.: US 9,497,529 B2
(45) Date of Patent: Nov. 15, 2016

(54) MICROPHONE PORT WITH FOREIGN MATERIAL INGRESS PROTECTION

(71) Applicant: Apple Inc., Cupertino, CA (US)

(72) Inventors: Peter N. Jeziorek, Mountain View, CA (US); Justin D. Crosby, Cupertino, CA (US); Trang Thi-Thanh Nguyen, Mountain View, CA (US); Michelle R. Goldberg, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 27 days.

(21) Appl. No.: 14/183,306

(22) Filed: Feb. 18, 2014

(65) Prior Publication Data

US 2015/0237431 A1 Aug. 20, 2015

(51) Int. Cl.

| | |
|---|---|
| ***H04R 1/02*** | (2006.01) |
| ***H04R 1/08*** | (2006.01) |
| *H04R 19/00* | (2006.01) |
| *H04R 19/04* | (2006.01) |

(52) U.S. Cl.

CPC ..... *H04R 1/086* (2013.01); *H04R 19/005* (2013.01); *H04R 19/04* (2013.01); *H04R 2499/11* (2013.01)

(58) Field of Classification Search

CPC ..... H04R 1/04; H04R 1/02; H04R 1/023; H04R 1/086; H04R 2201/021; H04R 2201/003; H04R 2201/029; H04R 2460/17; H04R 2499/11; H04R 2499/15

USPC ..... 381/87, 91, 361, 355, 357, 365, 375, 381/359, 122, 369

See application file for complete search history.

(56) References Cited

U.S. PATENT DOCUMENTS

| | | | | |
|---|---|---|---|---|
| 8,170,266 | B2 | 5/2012 | Hopkinson et al. | |
| 8,472,648 | B2 | 6/2013 | Wang et al. | |
| 8,488,973 | B2 | 7/2013 | Avenson et al. | |
| 8,650,925 | B2 | 2/2014 | Hankey et al. | |
| 2004/0168575 | A1* | 9/2004 | Isogawa | B01D 46/0032 96/134 |
| 2011/0255726 | A1* | 10/2011 | Yu | H04R 1/025 381/332 |
| 2013/0094126 | A1* | 4/2013 | Rappoport | G02B 27/01 361/679.01 |
| 2013/0241045 | A1* | 9/2013 | Goida | B81B 7/0061 257/704 |
| 2014/0001580 | A1* | 1/2014 | Bolognia | B81C 1/00333 257/416 |
| 2014/0003632 | A1 | 1/2014 | Reinisch | |
| 2014/0008740 | A1 | 1/2014 | Wang et al. | |
| 2014/0044297 | A1* | 2/2014 | Loeppert | H04R 1/04 381/355 |
| 2014/0299948 | A1* | 10/2014 | Wang | H04R 19/005 257/416 |

FOREIGN PATENT DOCUMENTS

| | | |
|---|---|---|
| WO | 2013136063 | 9/2013 |
| WO | 2014022542 | 6/2014 |

* cited by examiner

*Primary Examiner* — Ahmad F Matar
*Assistant Examiner* — Sabrina Diaz
(74) *Attorney, Agent, or Firm* — Kilpatrick Townsend & Stockton LLP

(57) ABSTRACT

An electronic device may be provided with a microphone in a microphone port. A shield may cover a microelectromechanical systems microphone device on a microphone substrate. An opening in the microphone substrate may form a sound port for the microphone. The microphone port may be formed by perforations in the microphone substrate or other layers such as a flexible printed circuit layer, a sheet metal layer, a layer of adhesive, a flexible polymer carrier layer in an adhesive tape, or an electronic device housing. The perforations may be sufficiently small to help resist the intrusions of foreign material such as liquid and dirt into the sound port of the microphone. Larger openings may be formed in other structures such as an electronic device housing. The larger openings may serve as sound passageways for the microphone port while being sufficiently large to resist clogging.

7 Claims, 12 Drawing Sheets

MICROPHONE PORT WITH FOREIGN MATERIAL INGRESS PROTECTION

BACKGROUND

This relates generally to electronic devices and, more particularly, to electronic devices with openings for audio input ports.

Electronic devices often include audio components such as speakers and microphones. Audio components are generally mounted within audio ports in device housings. For example, a microphone may be mounted in a microphone port located along the edge of a metal or plastic electronic device housing.

Microphones can be damaged by exposure to liquid or dirt. Accordingly, protective structures are often formed in a microphone ports. As an example, a microphone port may be provided with a layer of plastic mesh fabric. The mesh may have small openings that help prevent intrusion of liquid or dirt into the interior of the microphone port. The small openings in the mesh may be susceptible to clogging with skin oils or other materials, so a coarse screen or a housing, with larger openings may be placed over the mesh to help protect the mesh. Coarse screens are also sometimes incorporated into microphone ports to enhance the appearance of the microphone port.

Microphone ports with protective structures such as these may be complex and undesirably bulky. Also, the multitude of layers used with these structures can introduce potential leak paths to the interior of the device, providing coupling to internal device noise which is to be avoided.

It would therefore be desirable to be able to provide improve audio port structures such as improved microphone ports in electronic devices.

SUMMARY

An electronic device may be provided with a microphone port. A microphone may be mounted within the electronic device in alignment with the microphone port. The microphone port may be formed by sound passageways that allow sound to enter the electronic device and reach a sound port in the microphone.

The microphone may be formed from a microelectromechanical systems microphone device mounted on a microphone substrate. A shield may cover the microelectromechanical systems microphone device and an associated integrated circuit with microphone support circuitry. Solder or adhesive may be used in attaching the shield to the microphone substrate. An opening in the microphone substrate may form the sound port for the microphone.

The microphone port may be formed by perforations in the microphone substrate or perforations in other layers such as a flexible printed circuit layer to which the microphone substrate is attached, a planar member such as a sheet metal layer, a layer of adhesive, a flexible polymer carrier layer in an adhesive tape, or an electronic device housing.

The perforations may be sufficiently small to help resist the intrusion of foreign material such as liquid and dirt into the microphone port and therefore the sound port of the microphone. Larger openings that overlap the perforations may also be formed in structures associated with the microphone port. The larger openings may, for example, be formed as part of an electronic device housing.

DETAILED DESCRIPTION

Electronic devices may be provided with audio components. Audio components in an electronic device may include speakers, tone generators, or other components that generate sound. Audio components may also include components that measure sound such as microphones. Audio ports may be provided in electronic device housings to accommodate audio components such as these. With one suitable arrangement, which is sometimes described herein as an example, an electronic device housing is provided with a microphone port for accommodating a microphone. The microphone port includes structures that help prevent intrusion of contaminants such as liquid and dirt particles. In general, any suitable type of component may be mounted in a port of this type (e.g., a speaker or other sound-generating audio component a light-generating component, or other device component). Configurations in which a device is provided with a microphone and microphone port are described as an example. In general, however, electronic devices may be provided with any suitable type of port that prevents intrusion of contaminants such as liquid and dirt particles.

Illustrative electronic devices of the types that may be provided with ports such as microphone ports are shown in FIGS. 1, 2, 3, and 4.

Figure 1:
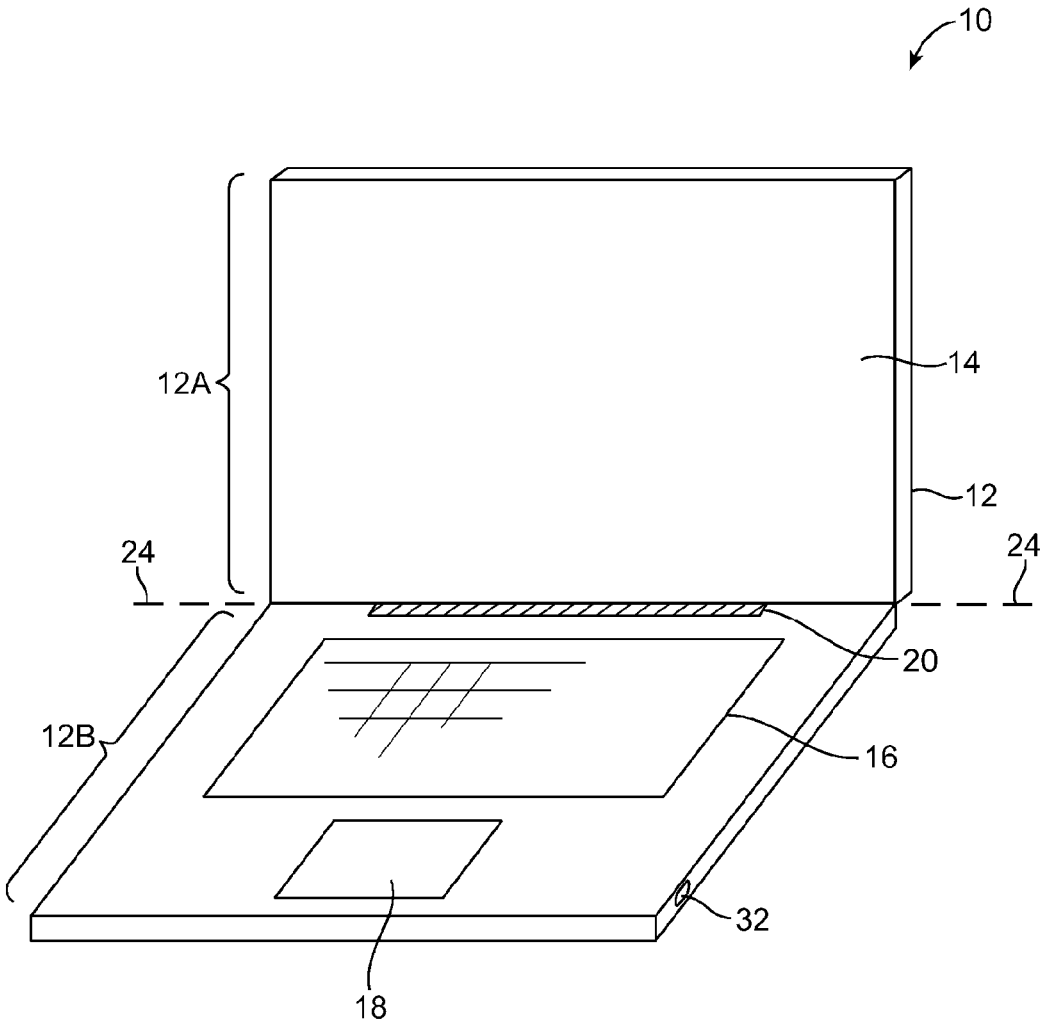
FIG. 1 is a perspective view of an illustrative electronic device such as a laptop computer in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in housing 12A. Upper housing 12A, which may sometimes be referred to as a display housing or lid, is placed in a closed position by rotating upper housing 12A towards lower housing 12B about rotational axis 24. Microphone port 32 may be formed on an edge of housing 12 or elsewhere in housing 12.

Figure 2:
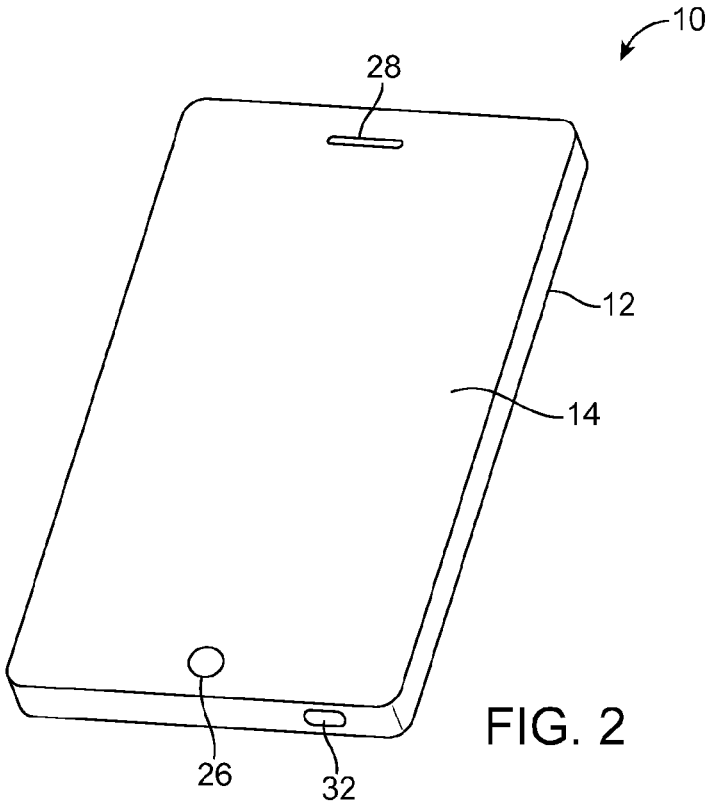
FIG. 2 is a perspective view of an illustrative electronic device such as a handheld electronic device in accordance with an embodiment.

FIG. 2 shows an illustrative configuration for electronic device 10 based on a handheld device such as a cellular telephone, music player, gaming device, navigation unit, or other compact device. In this type of configuration for device 10, housing 12 has opposing front and rear surfaces. Display 14 is mounted on a front face of device 10 12. Display 14 may have an exterior layer that includes openings for components such as button 26 and speaker port 28. Microphone port 32 may be formed along the lower edge of housing 12 as shown in FIG. 2 or may be formed elsewhere in housing 12.

Figure 3:
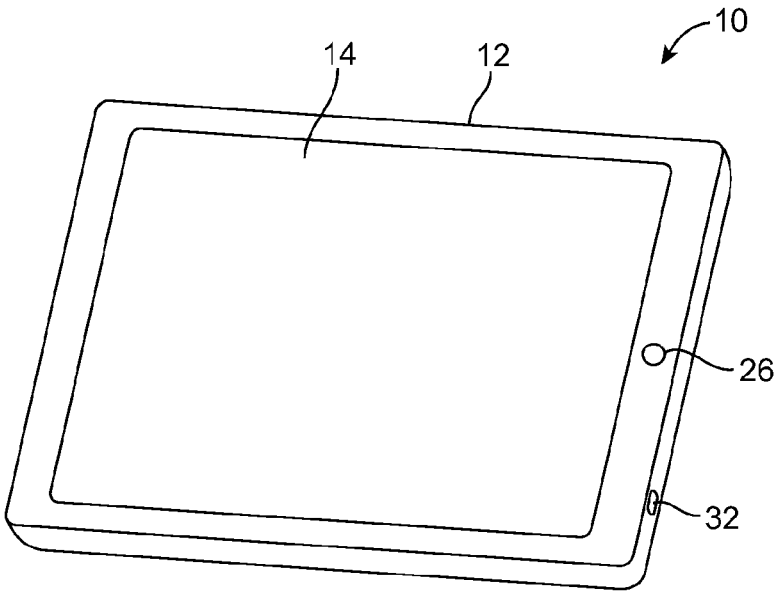
FIG. 3 is a perspective view of an illustrative electronic device such as a tablet computer in accordance with an embodiment.

In the example of FIG. 3, electronic device 10 is a tablet computer. In electronic device 10 of FIG. 3, housing 12 has opposing planar front and rear surfaces. Display 14 is mounted on the front surface of housing 12. As shown in FIG. 3, display 14 has an opening to accommodate button 26. Microphone port 32 may be formed along one of the edges of housing 12 or elsewhere in housing 12.

Figure 4:
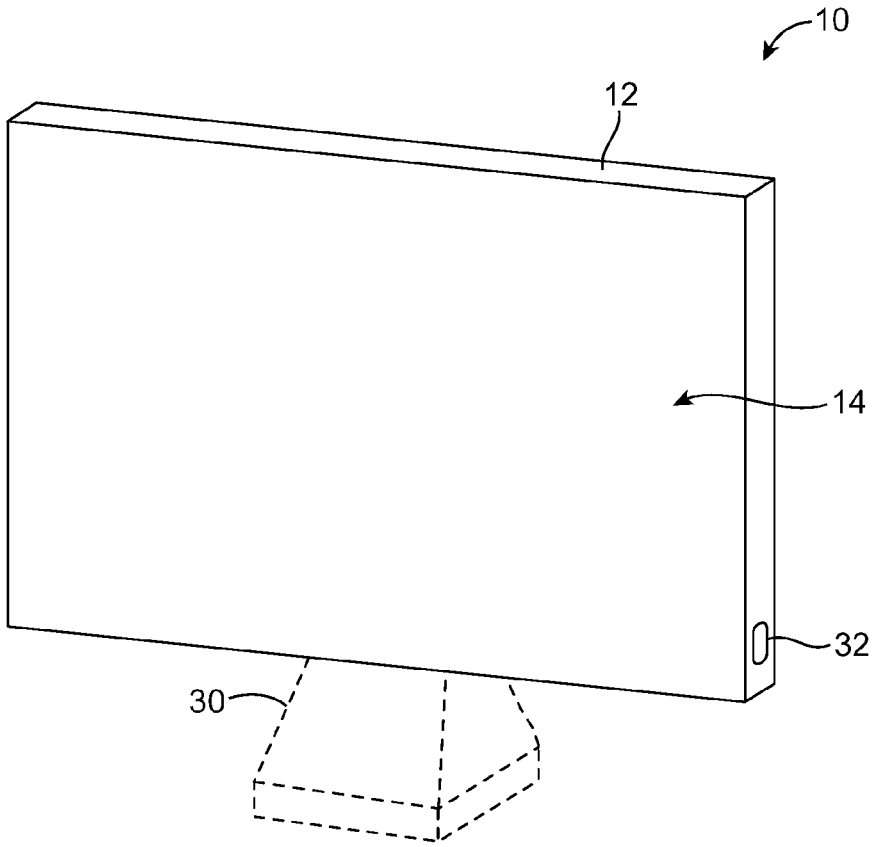
FIG. 4 is a perspective view of an illustrative electronic device such as a display for a computer or television in accordance with an embodiment.

FIG. 4 shows an illustrative configuration for electronic device 10 in which device 10 is a computer display, a computer that has an integrated computer display, or a television. Display 14 is mounted on a front face of housing 12. With this type of arrangement, housing 12 for device 10 may be mounted on a wall or may have an optional structure such as support stand 30 to support device 10 on a flat surface such as a tabletop or desk. As shown in FIG. 4, microphone port 32 may be formed along one of the edges of housing 12 (as an example).

Display 14 may be a liquid crystal display, an organic light-emitting diode display, a plasma display, an electrophoretic display, an electrowetting display, a display using other types of display technology, or a display that includes display structures formed using more than one of these display technologies.

Figure 5:
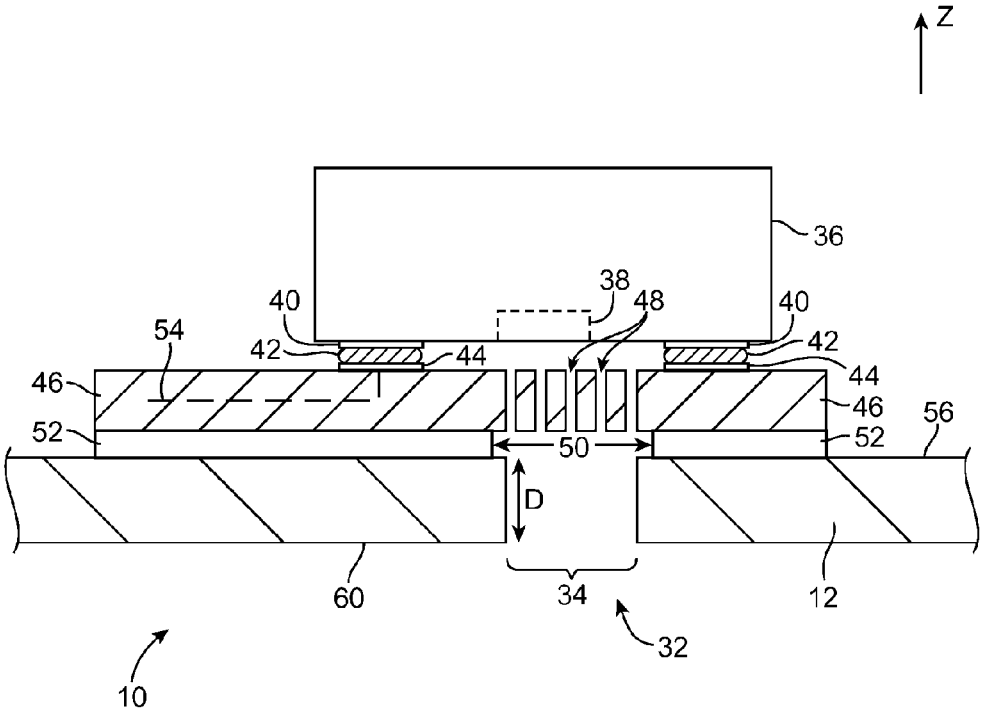
FIG. 5 is a cross-sectional side view of a portion of an electronic device having a microphone port that includes perforations in a flexible printed circuit in accordance with an embodiment.

A cross-sectional side view of a portion of electronic device 10 (e.g., a device such as devices 10 of FIGS. 1, 2, 3, or 4 or other suitable electronic device) is shown in FIG. 5. In the configuration of FIG. 5, microphone port 32 has been formed from opening 34 in housing 12 and from a group of openings 48 in a printed circuit such as flexible printed circuit 46.

Microphone 36 may be mounted on flexible printed circuit 46 in alignment with openings 48 and opening 34. By aligning microphone 36 with the openings of microphone port 32, microphone 36 can receive sound through microphone port 32 during operation.

Microphone 36 may be a microelectromechanical systems (MEMS) microphone or other suitable type of microphone. Region 38 may serve as a sound port for microphone 36 (i.e., microphone 36 may receive sound through an opening in the substrate of the package for microphone 36 in region 38). As shown in FIG. 5, sound port (opening) 38 may be aligned with the openings of microphone port 32 such as openings 48 and opening 34 to ensure that sound from the exterior of device 10 can be satisfactorily received by microphone 36.

Circuitry and other structures within microphone 36 are coupled to microphone terminals that are soldered to flexible printed circuit 46. Solder connections may also help mechanically attach microphone 36 to flexible printed circuit 46. As shown in the example of FIG. 5, microphone 36 may have contacts 40 that mate with corresponding contacts 44 on flexible printed circuit 46. Solder 42 may be used for connecting contacts 40 to contacts 44. If desired, a ring-shaped solder connection that runs around the periphery of microphone 36 may he used in connecting microphone 36 to flexible printed circuit 46.

Flexible printed circuit 46 may contain one or more dielectric layers and one or more layers of patterned metal traces for forming contacts 42 and internal signal traces 54. Flexible printed circuit 46 may be formed from a sheet of polyimide or a layer of other flexible polymer.

Adhesive 52 such as pressure sensitive adhesive may be used to attach flexible printed circuit 46 to a structure in device 10 such as inner surface 56 of electronic device housing (housing wall) 12. Adhesive layer 52 may have an opening such as opening 50 that forms part of microphone port 32. As shown in FIG. 5, opening 34 in housing 12, opening 50 in adhesive layer 52, and openings 48 in flexible printed circuit 46 may be aligned to form microphone port 32 and may be aligned with sound port 38 of microphone 36, so that sound from the exterior of device 10 may reach sound port 38 through microphone port 32.

Opening 34 may have a relatively large size (e.g., a diameter of 0.1 mm or more, 0.2 mm or more, 0.5 mm or more, 1 mm or more, 0.1-2 mm, 0.5-5 mm, etc). Opening 50 may have a size comparable to that of opening 34. Openings 48 may have smaller diameters than openings such as openings 50 and 34. For example, openings 48 may each have a diameter of less than 0.2 mm, less than 0.1 mm, less than 0.05 mm, less than 0.02 mm, less than 0.01 mm, less than 0.005 mm, 0.001-0.05 mm, 0.001-0.02 mm, or other suitable size. The use of relatively small diameters for openings 48 may help prevent intrusion of liquid, dirt, and other foreign material into sound opening 38, thereby preventing microphone 36 from becoming blocked with contaminants that could prevent sound from passing through opening 38 to the interior of microphone 36. Small openings such as openings 48 of FIG. 5 are sometimes referred to as microperforations ("microperf"). Microperforations 48 may be circular, square, rectangular, oval, may have outlines with curved edges, straight edges, or a combination of curved and straight edges, or may have other suitable shapes (when viewed in vertical direction Z).

Very small openings such as some microperforations 48 may become clogged in the presence of finger oils or other environmental contaminants. By recessing microperforations 48 within opening 34 (i.e., at a depth D away from exterior housing surface 60), microperforations 48 are protected from contact with a user's fingers and are therefore less likely to become clogged than if microperforations 48 were formed on the outermost surface of device 10. If desired, however, microperforations 48 may be located on the outermost surface of housing 12 and/or flexible printed circuit 46 may be located in a more exposed location. The configuration of FIG. 5 is merely illustrative.

Figure 6:
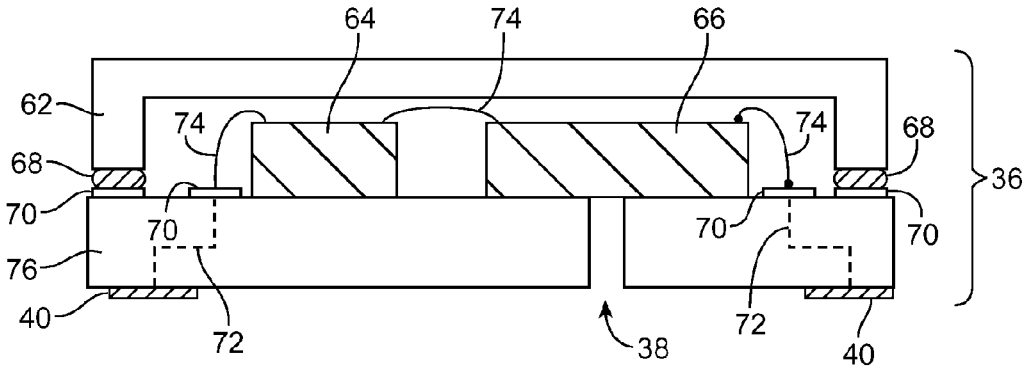
FIG. 6 is a cross-sectional side view of an illustrative microphone of the type that may be mounted in a microphone port In an electronic device in accordance with an embodiment.

FIG. 6 is a cross-sectional side view of an illustrative microphone for device 10. As shown in FIG. 6, microphone 36 may have a substrate such as microphone substrate 76. Microphone substrate 76 may be formed from a dielectric material such as rigid printed circuit board material (as an example). Substrate 76 may include signal lines formed from patterned metal traces 72. Sound opening 38 may be formed from an opening in substrate 76. Microphone 36 may have a semiconductor die that forms microelectromechanical systems (MEMS) microphone device 66 and may have support circuitry such as application-specific integrated circuit die 64. Wire bonds 74 and/or solder connections may be used to couple device 66, integrated circuit 64 and/or other microphone circuitry to contacts 70. Metal shield 62 may be coupled to metal traces such as contacts 70 using solder 68. In this configuration, shield 62 covers integrated circuit 64 and microelectromechanical systems microphone device 66. Traces 72 may electrically contacts 70 and microphone contacts 40. Other configurations may be used for forming microphone 36 if desired. The example of FIG. 6 is merely illustrative.

Figure 7:
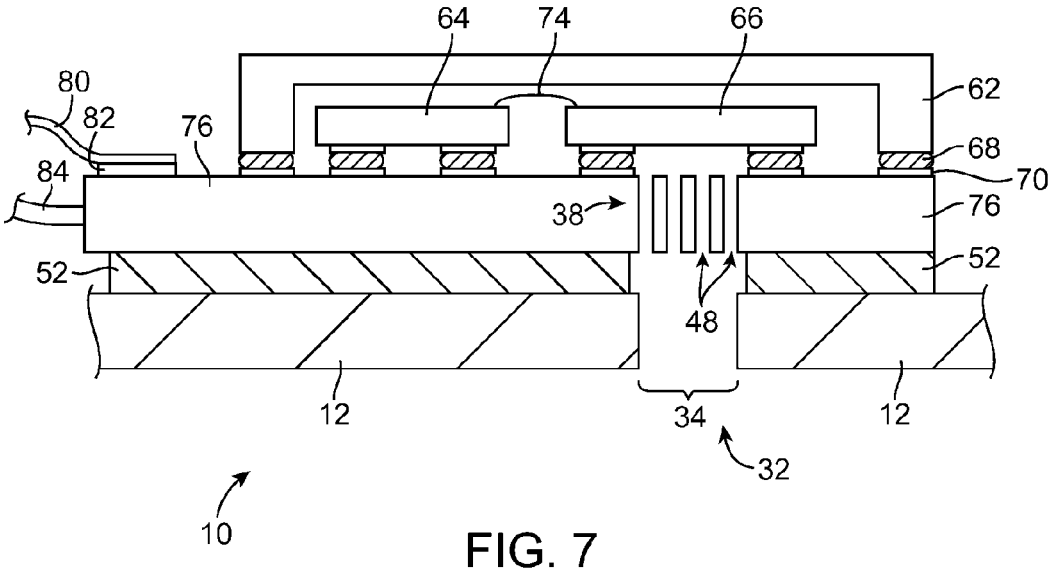
FIG. 7 is a cross-sectional side view of a portion of an electronic device having a microphone port that includes perforations on a microphone substrate on which microphone structures such as a microelectromechanical systems microphone device and integrated circuit with microphone support circuitry have been, mounted in accordance with an embodiment.

As shown in FIG. 7, perforations such as microperforations 48 for microphone port 32 may be formed directly in microphone substrate 76, rather than in a separate printed circuit such as printed circuit 46 of FIG. 5. Adhesive such as pressure sensitive adhesive 52 may attach microphone substrate 76 and therefore microphone 36 to inner surface 56 of housing 12. Microperforations 48 may be aligned with microelectromechanical systems microphone device 66 (i.e., the MEMS microphone component of microphone 36). This allows microperforations 48 to serve both as microphone sound port 38 for microphone 36 and as a structure that blocks dirt, liquid, and other foreign material so that this foreign material does not interfere with sound port 38. Signals may be routed from microphone, 36 to a motherboard or other printed circuit in device 10 using a flexible printed circuit that is coupled to substrate 76. For example, signals may be conveyed using flexible printed circuit 80 and connector 82 on substrate 76 or using integral flexible printed circuit tail 84. Connector 82 may be, for example, a board-to-board connector. Flexible printed circuit tail 84 may be a length of flexible printed circuit material that extends out of rigid printed circuit board material that is used in forming substrate 76 (i.e., microphone substrate 76 may be formed from a "rigid flex" printed circuit).

Figure 8:
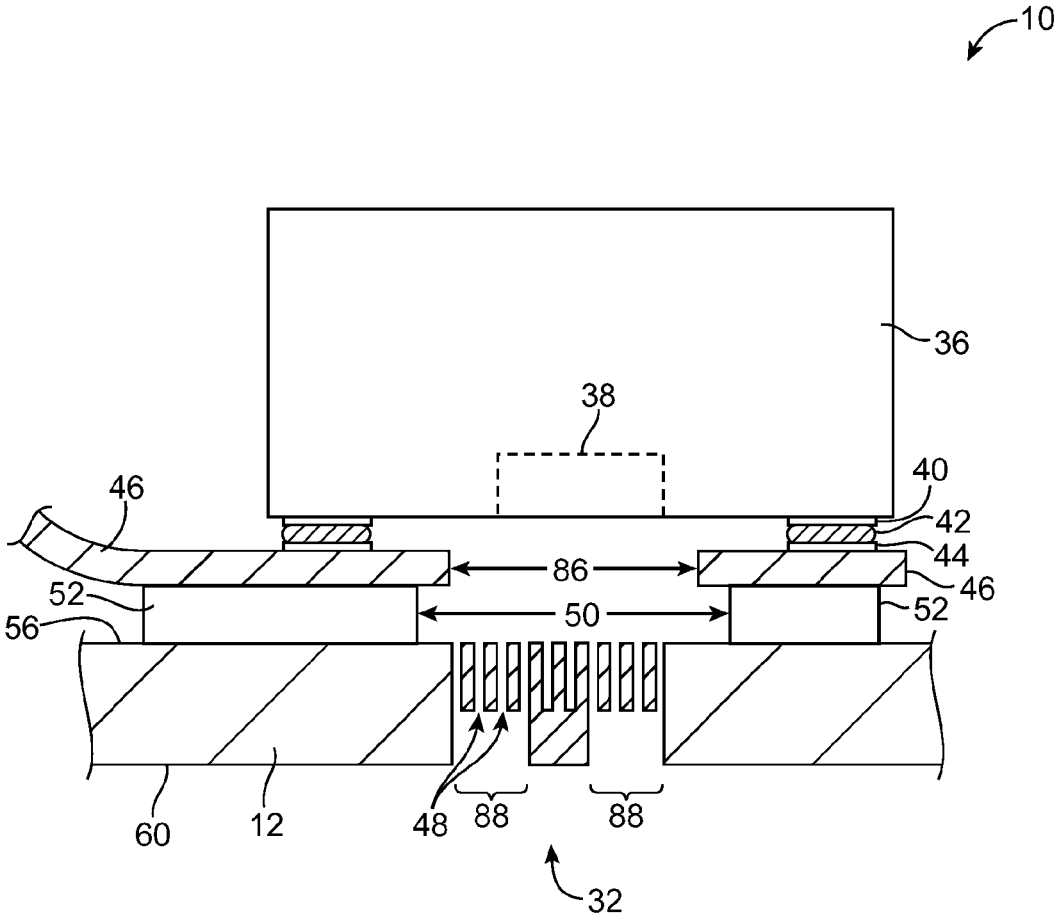
FIG. 8 is a cross-sectional side view of a portion of an electronic device having a microphone port that includes overlapping small and large perforations in a device housing in accordance with an embodiment.

If desired, microphone port 32 may be formed using microperforations in housing 12. As shown in FIG. 8, for example, microphone port 32 may have a plurality of micro perforations 48 that are formed in inner surface 56 of housing 12. Microperforations 48 may extend through housing 12 or may, as shown in FIG. 8, extend only partway through housing 12. In the FIG. 8 example, larger openings 88 (i.e., openings that have larger diameters than the diameters of microperforations 48 and that therefore each overlap multiple microperforations 48) may be formed on exterior surface 60. Larger openings 88 penetrate part way into housing 12 from surface 60 of housing 12 to opposing surface 56 of housing 12. Microperforations 48 extend part way from surface 56 into housing 12. Openings 88 join up with openings 48 in the middle of housing 12, thereby forming sound passageways for microphone port 32.

The larger size of openings 88 (e.g., 0.1-0.2 mm, 0.05-0.3 mm, more than 0.1 mm, more than 0.2 mm, more than 0.3 mm, or other suitable size) help prevent openings 88 from becoming clogged in the even that a user's fingers rub across exterior surface 60 of housing 12 at microphone port 32. The smaller size of openings 48 helps ensure that openings 48 will serve as a barrier to the intrusion of foreign material such as undesired liquid and dirt particles.

Figure 9:
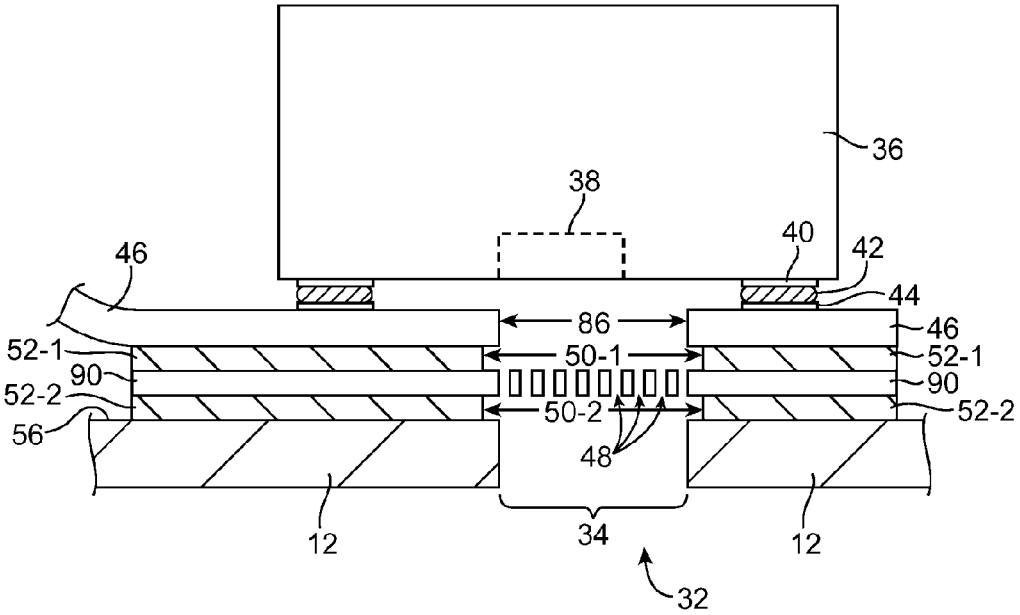
FIG. 9 is a cross-sectional side view of a portion of an electronic device having a microphone port formed using a planar member such as a sheet of metal with perforations in accordance with an embodiment.

In the illustrative configuration of FIG. 9, microperforations 48 have been formed in planar member 90. Microphone 36 may be mounted to flexible printed circuit 46 using solder 42 or other attachment mechanisms. Adhesive layer 52-1 may be used to attach flexible printed circuit 46 to member 90. Adhesive layer 52-2 may be used to attach member 90 to inner surface 56 of housing 12. Adhesive layers 52-1 and 52-2 may be formed from pressure sensitive adhesive or other adhesive. Openings in adhesive layers 52-1 and 52-2 may be aligned with the other openings of microphone port 32. For example, adhesive layer 52-1 may have opening 50 1, which is aligned with opening 86 of flexible printed circuit 46. Adhesive layer 52-2 may have opening 50-2, which is aligned with opening 86 of flexible printed circuit 46. Opening 34 in housing 12 may be aligned with openings 86, 50-1, and 50-2 and with microperforations 48 in member 90. Member 90 may be formed from a sheet of material such as plastic or metal. For example, member 90 may be a layer of stainless steel or other sheet of metal and may serve as a stiffener for flexible printed circuit 46. Microperforations 48 may allow sound to pass through microphone port 32 to sound opening 38 of microphone 36, while serving as a barrier to the intrusion of foreign material such as liquid and dirt particles. The shape and layout of perforations 48 may be selected to provide microphone port 32 with a desired cosmetic appearance.

Figure 10:
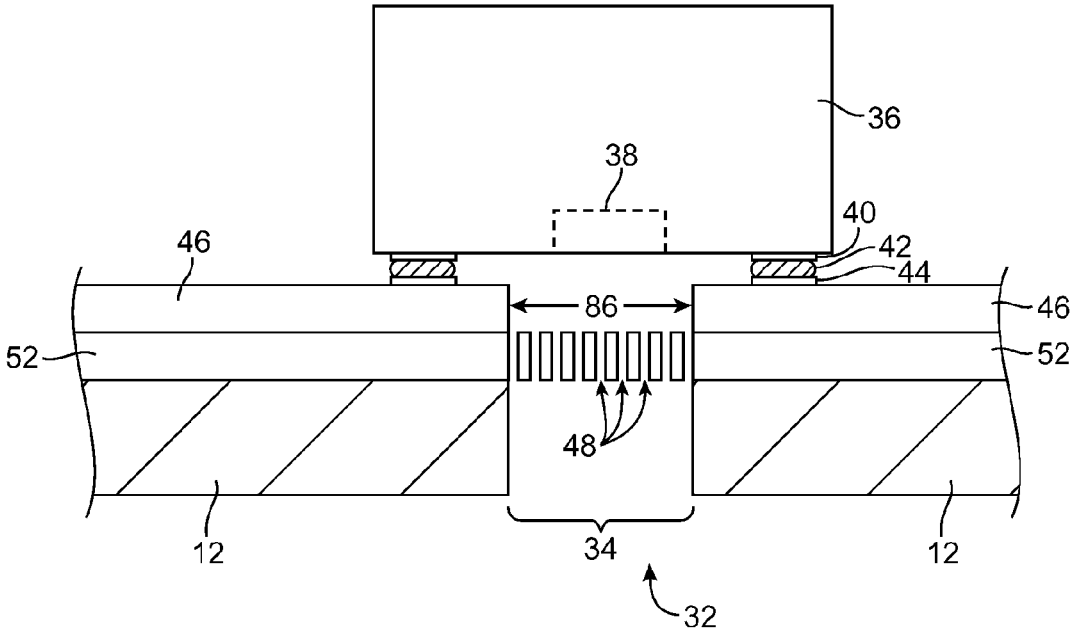
FIG. 10 is a cross-sectional side view of a portion of an electronic device having a microphone port formed using a planar member such as a layer of perforated adhesive in accordance with an embodiment.

FIG. 10 is a cross-sectional side view of a portion of electronic device 10 in a configuration in which microphone port 32 has sound passageways formed from microperforations 48 in a layer of adhesive (e.g., a planar member formed from a layer of pressure sensitive adhesive or a layer of other adhesive material). As shown in FIG. 10, microphone 36 may be mounted to. flexible printed circuit 46 using solder 42 or other attachment mechanisms. Adhesive layer 52 may be used to attach flexible printed circuit 46 to the inner surface of housing 12. Microperforations 48 may be formed in adhesive layer 52 in alignment with opening 86 in flexible printed circuit layer 46 and opening 34 in housing 12. Microperforations 48 may allow sound to pass through adhesive layer 52 in microphone port 32 to sound opening 38 of microphone 36, while serving as a barrier to the intrusion of foreign material such as liquid and dirt particles.

Figure 11:
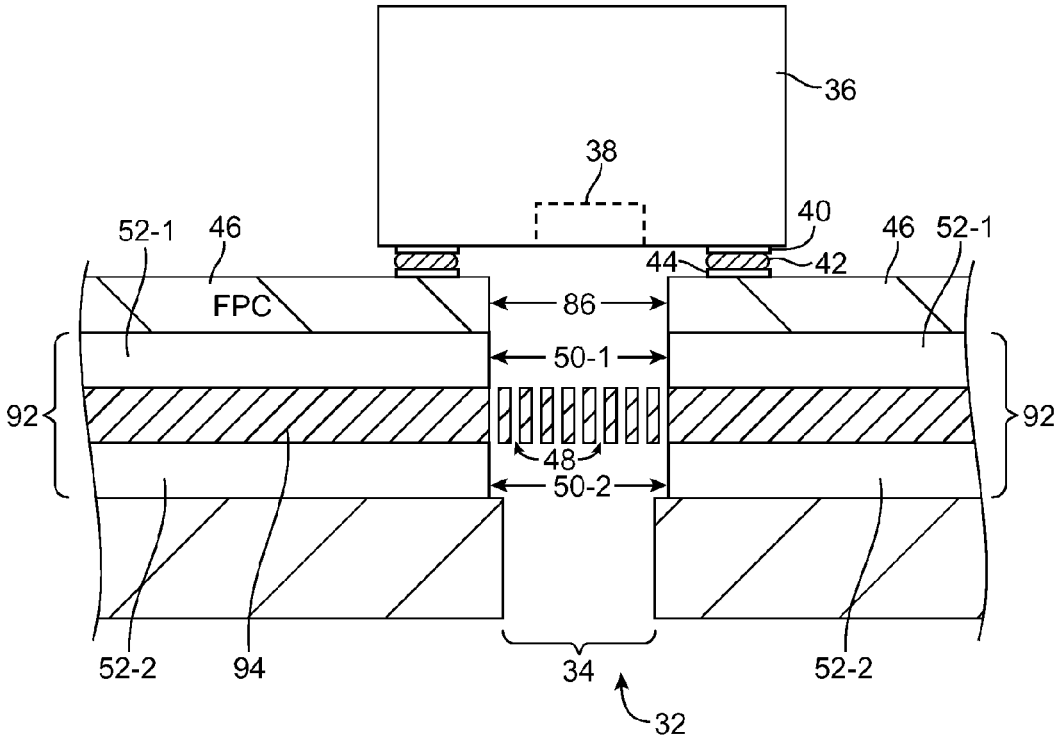
FIG. 11 is a cross-sectional side view of a portion of an electronic device having a microphone port formed using a perforated flexible polymer carrier film in a pressure sensitive adhesive tape in accordance with an embodiment.

Adhesive tape may be used in attaching flexible printed circuit 46 to housing 12, as shown in FIG. 11. With a configuration of the type shown in FIG. 11, flexible printed circuit 46 may be provided with an opening 86 that is aligned with sound port 38 of microphone 36. Microphone 36 may be mounted to flexible printed circuit 46 using solder 42. Adhesive tape 92 has a flexible polymer carrier layer such as carrier 94 sandwiched between upper adhesive layer 52-1 and lower adhesive layer 52-2, respectively. Tape 92 may be used to attach flexible printed circuit 46 to the inner surface of electronic device housing 12 in device 10. Adhesive layers 52-1 and 52-2 may be formed from pressure sensitive adhesive or other adhesive. Openings in adhesive layers 52-1 and 52-2 may be aligned with the other openings of microphone port 32. For example, adhesive layer 52-1 may have an opening such as opening 50-1 that is aligned with opening 86 of flexible printed circuit 46. Adhesive layer 52-2 may have an opening such as opening 50-2 that is aligned with opening 86 of flexible printed circuit 46. Opening 34 in housing 12 may be aligned with openings 86, 50-1, and 50-2 and with microperforations 48 in carrier 94. Microperforations 48 in carrier 94 may allow sound to pass through carrier 94 in microphone port 32 to sound opening 38 of microphone 36, while serving as a barrier to the intrusion of foreign material such as liquid and dirt particles.

Figure 12:
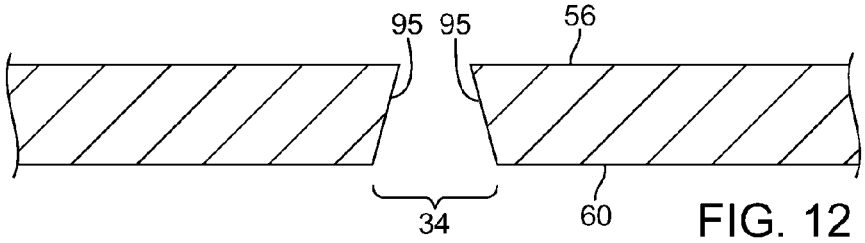
FIG. 12 is a cross-sectional side view of an illustrative housing opening for a microphone port in accordance with an embodiment.

If desired, openings such as openings 34 of FIGS. 5, 7, 9, 10, and 11 may be provided with tapered sidewalls, as shown in FIG. 12. Sidewalls 95 may taper outwardly so that opening 34 is larger on outer housing surface 60 than on inner housing surface 56, thereby enhancing the acoustic performance of microphone port 32.

Figure 13:
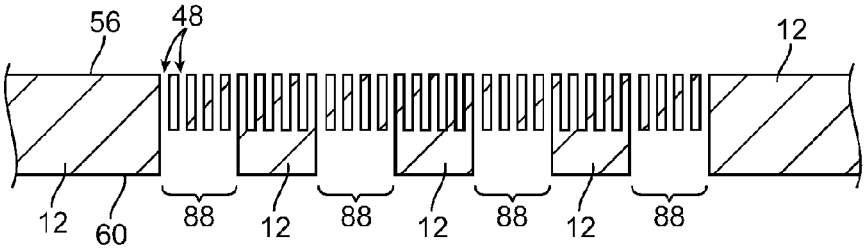
FIG. 13 is a cross-sectional side view of an illustrative series of overlapping fine and coarse housing openings for a microphone port in accordance with an embodiment.

FIG. 13 is a cross-sectional side view of a portion of housing 12 in which a microphone port opening is formed from overlapping larger and smaller openings. The overlapping larger and smaller openings create sound passageways through housing 12 for microphone port 32, as descried in connection with the illustrative example of FIG. 8. With the configuration of FIG. 13, microperforations 48 extend from inner surface 56 part way through housing 12. Larger openings (i.e., perforations with larger diameters than perforations 48) such as openings 88 may extend from outer surface 60 part way through housing 12. Openings 88 and microperforations 48 join to form sound passageways that allow sound to reach microphone 36. The larger size of openings 88 prevents openings 88 from becoming clogged with oils or other materials. The smaller size of microperforations 48 allows microperforations to prevent the intrusion of foreign materials such as liquid and dirt into the interior of device 10. If desired, openings such as openings 34 of FIGS. 5, 7, 9, 10, and 11 may be implemented using a configuration of the type shown in FIG. 13. When this type of arrangement is used, microperforations 48 on other layers in microphone port 32 (e.g., on flexible printed circuit 46, metal layer 90, adhesive tape carrier 94, etc., can be omitted or may be formed using enlarged openings).

Figure 14:
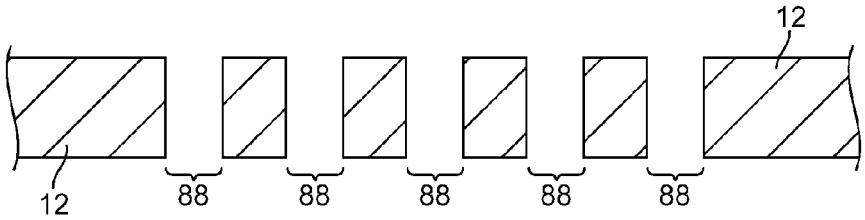
FIG. 14 is a cross-sectional side view of an illustrative housing with openings for forming a microphone port in accordance with an embodiment.

In the illustrative configuration of FIG. 14, port 32 has a pattern of housing openings 88 (e.g., relatively larger openings that have diameters of 0.1-0.2 mm, 0.05-0.3 mm, more than 0.1 mm, more than 0.2 mm, more than 0.3 mm, or other suitable size). This type of arrangement may be used to provide an outer set of sound passageways for microphone port 32 in place of openings such as openings 34 of FIGS. 5, 7, 9, 10, and 11.

Figure 15:
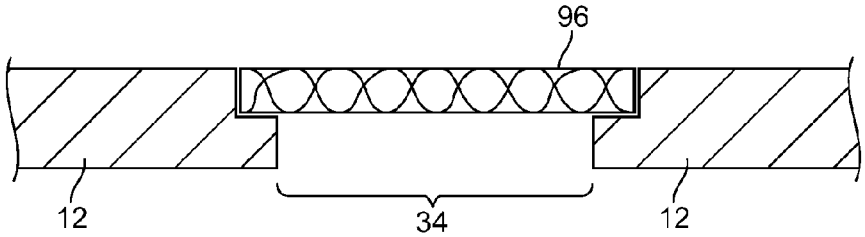
FIG. 15 is a cross-sectional side view of an illustrative housing with an opening filled with a mesh layer for a microphone port in accordance with an embodiment.

FIG. 15 shows how an opening such as openings 34 of FIGS. 5, 7, 9, 10, and 11 may be provided with a mesh layer such as mesh layer 96. Mesh layer 96 may have relatively small openings for preventing the intrusion of foreign material such as liquid and dirt or may have larger openings. For example, mesh layer 96 may have small openings such as openings that have a diameter of less than 0.2 mm, less than 0.1 mm, less than 0.05 mm, less than 0.02 mm, less than 0.01 mm, less than 0.005 mm, 0.001-0.05 mm, 0.001-0.02 mm, or other suitable size and/or may have larger openings such as openings of 0.1-0.2 mm, 0.05-0.3 mm, more than 0.1 mm, more than 0.2 mm, more than 0.3 mm, or other suitable size. Mesh 96 may be formed from interwoven fibers such as interwoven, plastic and/or metal fibers.

Figure 16:
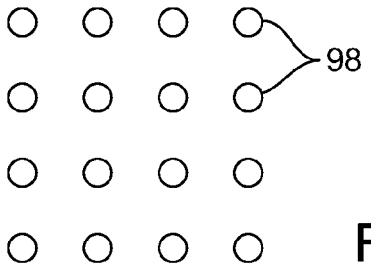
FIGS. 16 and 17 are diagrams showing illustrative patterns that may be used when forming microphone port openings in accordance with an embodiment.
Figure 17:
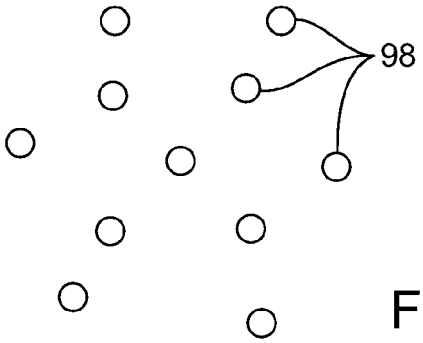

The openings of port 32 such as microperforations 48 and/or openings 88 may be formed in an array or other suitable pattern (see, e.g., the rectangular array of openings 98 of FIG. 16 and/or the circular pattern of openings 98 of FIG. 17). Other patterns of openings may be used if desired.

The foregoing is merely illustrative and various modifications can be made by those skilled in the art without departing from the scope and spirit of the described embodiments. The foregoing embodiments may be implemented individually or in any combination.

What is claimed is:

1. Apparatus, comprising:

an electronic device housing having opposing inner and outer surfaces;

a first plurality of openings each of which passes part way from the inner surface into the electronic device housing;

a second plurality of openings each of which has a larger diameter than the openings of the first plurality of openings and each of which passes part way from the outer surface into the electronic device housing, wherein the second plurality of openings joins with the first plurality of openings to form microphone port sound passageways through the electronic device housing; and a microphone having a sound port in alignment with the first plurality of openings that receives sound through the microphone port sound passageways, wherein the first plurality of openings is interposed between the second plurality of openings and the sound port.

2. The apparatus defined in claim 1 further comprising a flexible printed circuit to which the microphone is mounted, wherein the flexible printed circuit has an opening aligned with the sound port.

3. The apparatus defined in claim 2 further comprising a layer of adhesive that attaches the flexible printed circuit to the inner surface of the electronic device housing, wherein the layer of adhesive has an opening aligned with the opening in the flexible printed circuit.

4. Apparatus, comprising:

a microphone having a sound port;

a flexible printed circuit having an opening aligned with the sound port; and adhesive tape attached to the flexible printed circuit, wherein the adhesive tape has a flexible polymer carrier layer with a plurality of perforations aligned with the opening in the flexible printed circuit, wherein the adhesive tape comprises an adhesive layer formed on a surface of the polymer carrier layer, and wherein the adhesive layer comprises an opening that is larger than each of the plurality of perforations in the flexible polymer layer.

5. The apparatus defined in claim 4 wherein the adhesive layer attaches the flexible polymer carrier layer to the flexible printed circuit.

6. The apparatus defined in claim 5 wherein the opening in the adhesive layer is aligned with the opening in the flexible printed circuit.

7. The apparatus defined in claim 4 further comprising:

an electronic device housing having an opening aligned with the opening in the flexible printed circuit, wherein the adhesive layer is a first adhesive layer that attaches the flexible polymer carrier layer to the flexible printed circuit, wherein the adhesive tape includes a second adhesive layer that attaches the flexible polymer carrier layer to the electronic device housing, wherein the opening in the first adhesive layer is aligned with the opening in the flexible printed circuit and wherein the second adhesive layer has an additional opening aligned with the opening in the electronic device housing.

* * * * *